US008587196B2

(12) United States Patent
Shimoi et al.

(10) Patent No.: US 8,587,196 B2
(45) Date of Patent: Nov. 19, 2013

(54) PHOTOMULTIPLIER TUBE

(75) Inventors: Hideki Shimoi, Hamamatsu (JP); Hiroyuki Kyushima, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 12/904,661

(22) Filed: Oct. 14, 2010

(65) Prior Publication Data

US 2012/0091890 A1 Apr. 19, 2012

(51) Int. Cl.
*H01J 43/10* (2006.01)

(52) U.S. Cl.
USPC ..... 313/533; 313/103 CM

(58) Field of Classification Search
USPC ..... 313/533–537, 103 CM
See application file for complete search history.

(56) References Cited

U.S. PATENT DOCUMENTS

| | | | |
|---|---|---|---|
| 5,264,693 | A | 11/1993 | Shimabukuro et al. |
| 5,568,013 | A | 10/1996 | Then et al. |
| 5,744,908 | A | 4/1998 | Kyushima |
| 7,049,747 | B1 | 5/2006 | Goodberlet et al. |
| 7,294,954 | B2 | 11/2007 | Syms |
| 2006/0220554 | A1 | 10/2006 | Ohmura et al. |
| 2009/0218944 | A1 | 9/2009 | Kyushima et al. |
| 2009/0224666 | A1 | 9/2009 | Kyushima et al. |
| 2009/0283290 | A1 | 11/2009 | Shimoi et al. |
| 2010/0213837 | A1 | 8/2010 | Shimoi et al. |
| 2010/0213838 | A1 | 8/2010 | Sugiyama et al. |

FOREIGN PATENT DOCUMENTS

| | | |
|---|---|---|
| EP | 0 690 478 | 1/1996 |
| JP | H5-182631 | 7/1993 |
| JP | 08-017389 | 1/1996 |
| JP | H11-003677 | 1/1999 |
| JP | H11-204076 | 7/1999 |
| JP | 2007-048633 | 2/2007 |
| JP | 2007-048712 | 2/2007 |
| JP | 2007-095381 | 4/2007 |

OTHER PUBLICATIONS

"Succeeded in developing the advanced photomultiplier using the world's first MEMS technology for manufacturing semiconductors in an effort to address miniaturization trend and mass production," Hamamatsu Photonics K.K. News Release, Sep. 28, 2010, p. 1-p. 5, with English Translation.

"μ PMT—Future PMT from Hamamatsu—", Hamamatsu Photonics K.K. Technical Information, Feb. 2010.

U.S. Appl. No. 12/904,641, filed Oct. 14, 2010, Shimoi.

*Primary Examiner* — Anh Mai
*Assistant Examiner* — Brenitra M Lee
(74) *Attorney, Agent, or Firm* — Drinker Biddle & Reath LLP

(57) ABSTRACT

The photomultiplier tube 1 is provided with a casing 5 made of an upper frame 2 and a lower frame 4, an electron multiplying part 33 having dynodes 33*a* to 331 arrayed on the lower frame 4, a photocathode 41, and an anode part 34. Conductive layers 202 are installed on an opposing surface 20*a* of the upper frame 2. The electron multiplying part 33 is provided with base parts 52*a* to 52*d* of the respective dynodes 33*a* to 33*d* installed on the side of the lower frame 4, and power supplying parts 53*a* to 53*d* connected to the conductive layers 202 at one end parts of the respective base parts 52*a* to 52*d* in a direction along the opposing surface 40*a*. The base parts 52*a* to 52*d* are constituted in such a manner that the both end parts are joined to the opposing surface 40*a*, the central part is spaced away from the opposing surface 40*a*, and a cross sectional area at the one end part on the side of each of the power supplying parts 53*a* to 53*d* is made greater than a cross sectional area at another end part.

4 Claims, 13 Drawing Sheets

PHOTOMULTIPLIER TUBE

BACKGROUND OF THE INVENTION

1. Field of the Invention

The present invention relates to a photomultiplier tube for detecting incident light from outside.

2. Related Background Art

Conventionally, compact photomultiplier tubes by utilization of fine processing technology have been developed. For example, a flat surface-type photomultiplier tube which is arranged with a photocathode, dynodes and an anode on a translucent insulating substrate is known (refer to Patent Document 1 given below). The above-described structure makes it possible to detect weak light and also downsize a device.

Patent Document 1: U.S. Pat. No. 5,264,693

SUMMARY OF THE INVENTION

However, in the above-described conventional photomultiplier tube, since structures different in potential are arranged in close proximity to each other on an insulating substrate, there is found a decrease in withstand voltage between the structures when the photomultiplier tube is downsized, and this is a problem. In particular, at an electron multiplying part, generated secondary electrons are made incident onto the insulating substrate, by which there is a concern that the insulating substrate is electrically charged to decrease a withstand voltage between adjacent dynodes. Further, the dynodes are decreased in physical strength according to the decrease in size. Therefore, the dynodes are deformed or broken due to connection of power supplying members, and there is also a concern that the withstand voltage is decreased.

Under the above-described circumstances, the present invention has been made in view of the above problem, an object of which is to provide a photomultiplier tube capable of suppressing a decrease in withstand voltage even when it is downsized.

In order to solve the above problem, the photomultiplier tube of the present invention is provided with a housing which includes a first substrate and a second substrate which are arranged so as to oppose each other, with the respective opposing surfaces made with an insulating material, an electron multiplying part which has a plurality of stages of dynodes arrayed so as to be spaced away sequentially along one direction from a first end side to a second end side on the opposing surface of the first substrate, a photocathode which is installed on the first end side inside the housing so as to be spaced away from the electron multiplying part, thereby converting incident light from outside to photoelectrons to emit the photoelectrons, and an anode part which is installed on the second end side inside the housing so as to be spaced away from the electron multiplying part to take out electrons multiplied by the electron multiplying part as a signal, in which a power supplying part for supplying power to the electron multiplying part is installed on the opposing surface of the second substrate, the electron multiplying part is provided with supporting bases, each of which is electrically connected to the end part of each of the plurality of stages of dynodes on the side of the first substrate and installed so as to be astride electron multiplying channels formed with the plurality of stages of dynodes and a power supplying member which is formed so as to extend from one end part of both end parts of each of the supporting bases in a direction along the opposing surface of the first substrate to the second substrate and electrically connected to the power supplying part, the supporting base is constituted in such a manner that the both end parts are joined to the opposing surface, and also a central part held between the both end parts is spaced away from the opposing surface, and a cross sectional area along the opposing surface at the one end part of the both end parts on the side of the power supplying member is made greater than a cross sectional area at another end part of the both end parts.

According to the above-described photomultiplier tube, incident light is made incident onto the photocathode, thereby converted to photoelectrons, the photoelectrons are made incident onto the electron multiplying part formed with a plurality of stages of dynodes on the inner surface of the first substrate inside the housing and then multiplied accordingly, and the multiplied electrons are taken out from the anode part as an electric signal. Here, each of the dynodes is provided at an end part on the side of the first substrate with a supporting base, a power supplying member extending to the second substrate which opposes the first substrate from the first end part thereof is electrically connected to the supporting base, and the power supplying member is connected to the power supplying part installed on the inner surface of the second substrate, thereby power is supplied to each of the dynodes. Further, the supporting base is formed in such a manner that the both end parts thereof are joined to the opposing surface of the first substrate, the central part thereof is spaced away from the opposing surface and a cross sectional area along the opposing surface at the first end part on the side of the power supplying member is made greater than a cross sectional area at the second end part. Thereby, at a region of an electron multiplying channel where the insulating surface of the substrate easily takes charge by secondary electrons incident thereon, etc., which are made incident, each of the dynodes is spaced away from the insulating surface of the substrate. It is, therefore, possible to suppress a decrease in withstand voltage. Still further, the end part of the supporting base on the side of a site in contact with the power supplying part of the substrate is increased in strength, by which the electron multiplying part is secured for physical strength when pressure is applied due to contact for supplying power. It is, thus, possible to suppress a decrease in withstand voltage without deformation, breakage, etc.

It is preferable that a recessed part is formed on the opposing surface of the first substrate and the central part of the supporting base is arranged over the recessed part, thereby being spaced away from the opposing surface. In this instance, since the central part of the supporting base can be spaced away from the substrate without any decrease in strength of the electron multiplying part, it is possible to further suppress a decrease in withstand voltage.

It is also preferable that the recessed part is formed so as to be astride a plurality of supporting bases connected individually to the plurality of stages of dynodes. The above-described constitution makes it possible to further suppress a decrease in withstand voltage by preventing electric charge due to secondary electrons passing between the plurality of stages of dynodes.

Further, it is also preferable that the plurality of supporting bases corresponding to the plurality of stages of dynodes are arranged in such a manner that the one end part and the other end part are alternately placed along the opposing surface of the first substrate. When they are placed in the above-described manner, it is possible to increase a cross sectional area along the substrate at the end part of each of the supporting bases on the side of the power supplying member. Therefore, the electron multiplying part can be further increased in physical strength to suppress a decrease in withstand voltage.

DESCRIPTION OF THE PREFERRED EMBODIMENTS

Figure 1:
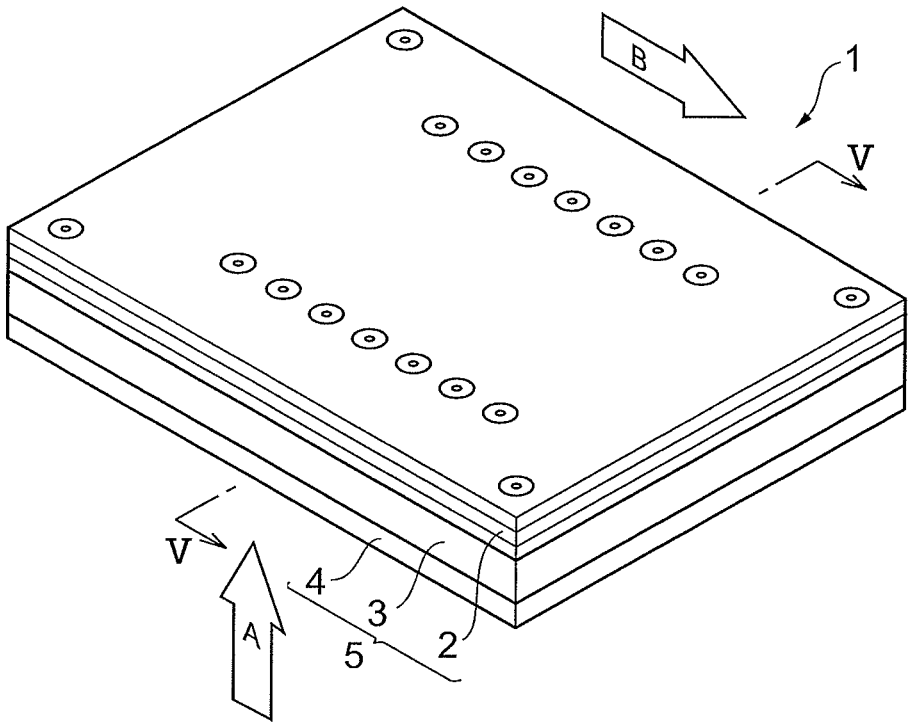
FIG. 1 is a perspective view of a photomultiplier tube which is related to one preferred embodiment of the present invention.

Hereinafter, a detailed description will be given for preferred embodiments of the photomultiplier tube related to the present invention by referring to drawings. In addition, in describing the drawings, the same or corresponding parts will be given the same reference numerals to omit overlapping description.

Figure 2:
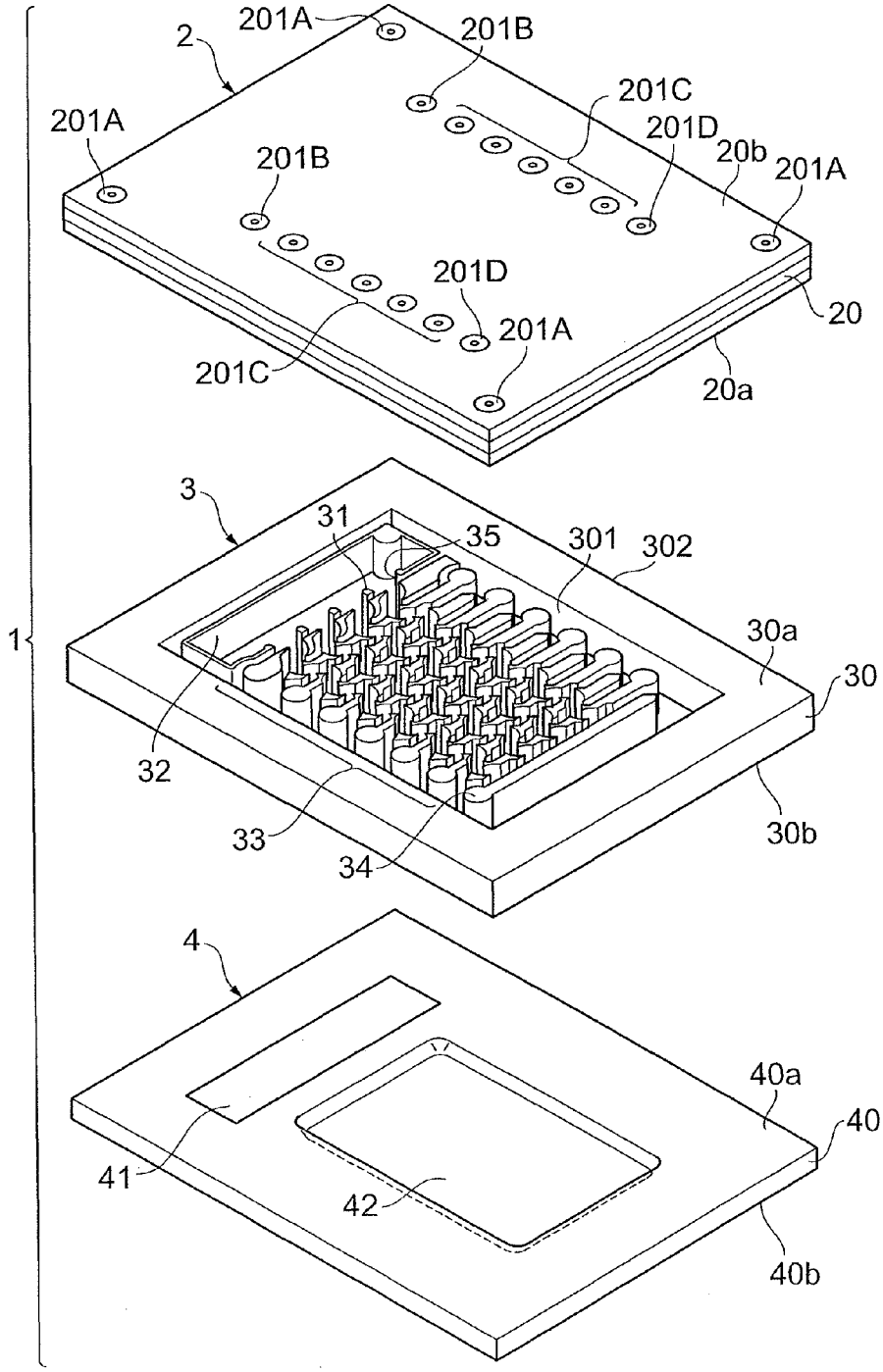
FIG. 2 is an exploded perspective view of the photomultiplier tube shown in FIG. 1.

FIG. 1 is a perspective view which shows a photomultiplier tube 1 related to one preferred embodiment of the present invention. FIG. 2 is an exploded perspective view which shows the photomultiplier tube 1 shown in FIG. 1.

The photomultiplier tube 1 shown in FIG. 1 is a photomultiplier tube having a transmission-type photocathode and provided with a casing 5, that is, a housing constituted with an upper frame (a second substrate) 2, a side wall frame 3, and a lower frame (a first substrate) 4 which opposes the upper frame 2, with the side wall frame 3 kept therebetween. The photomultiplier tube 1 is an electron tube such that when light is made incident from a direction at which a light incident direction onto the photocathode intersects with a direction at which electrons are multiplied at electron multiplying parts, that is, a direction indicated by the arrow A in FIG. 1, photoelectrons emitted from the photocathode are made incident onto the electron multiplying parts, thereby secondary electrons are subjected to cascade amplification in a direction indicated by the arrow B to take out a signal from the anode part.

It is noted that in the following description, the upstream side of an electron multiplying channel (the side of the photocathode) along a direction at which electrons are multiplied is given as "a first end side," while the downstream side (the side of the anode part) is given as "a second end side." Further, a detailed description will be given for individual constituents of the photomultiplier tube 1.

As shown in FIG. 2, the upper frame 2 is constituted with a wiring substrate 20 made mainly with rectangular flat-plate like insulating ceramics as a base material. As the above-described wiring substrate, there is used a multilayer wiring substrate such as LTCC (low temperature co-fired ceramics) in which microscopic wiring can be designed and also wiring patterns on front-back both sides can be freely designed. The wiring substrate 20 is provided on a main surface 20*b* thereof with a plurality of conductive terminals 201A to 201D electrically connected to the side wall frame 3, a photocathode 41, focusing electrodes 31, a wall-like electrode 32, electron multiplying parts 33, and the anode part 34 which are described later, to supply power from outside and take out a signal. The conductive terminal 201A is installed for supplying power to the side wall frame 3, the conductive terminal 201B for supplying power to the photocathode 41, the focusing electrodes 31 and the wall-like electrode 32, the conductive terminal 201C for supplying power to the electron multiplying parts 33, and the conductive terminal 201D for supplying power to the anode part 34 and taking out a signal respectively. These conductive terminals 201A to 201D are mutually connected to conductive layers and the conductive terminals (details will be described later) on an insulating opposing surface 20*a* which opposes the main surface 20*b* inside the wiring substrate 20, by which these conductive layers and the conductive terminals are connected to the side wall frame 3, the photocathode 41, the focusing electrodes 31, the wall-like electrode 32, the electron multiplying parts 33 and the anode part 34. Further, the upper frame 2 is not limited to a multilayer wiring substrate having the conductive terminals 201 but may include a plate-like member made with an insulating material such as a glass substrate on which conductive terminals for supplying power from outside and taking out a signal are installed so as to penetrate.

The side wall frame 3 is constituted with a rectangular flat-plate like silicon substrate 30 as a base material. A penetration part 301 enclosed by a frame-like side wall part 302 is formed from a main surface 30*a* of the silicon substrate 30 toward an opposing surface 30*b* thereto. The penetration part 301 is provided with a rectangular opening and an outer periphery of which is formed so as to run along the outer periphery of the silicon substrate 30.

Inside the penetration part 301, the wall-like electrode 32, the focusing electrodes 31, the electron multiplying parts 33 and the anode part 34 are arranged from the first end side to the second end side. The wall-like electrode 32, the focusing electrodes 31, the electron multiplying parts 33 and the anode part 34 are formed by processing the silicon substrate 30 according to RIE (Reactive Ion Etching) processing, etc., and mainly made with silicon.

The wall-like electrode 32 is a frame-like electrode which is formed so as to enclose a photocathode 41 to be described later when viewed from a direction completely opposite to an opposing surface 40*a* of the glass substrate 40 to be described later (a direction approximately perpendicular to the opposing surface 40*a*). Further, the focusing electrode 31 is an electrode for focusing photoelectrons emitted from the photocathode 41 and guiding them to the electron multiplying parts 33 and installed between the photocathode 41 and the electron multiplying parts 33.

The electron multiplying parts 33 are constituted with N stages (N denotes an integer of two or more) of dynodes (an electron multiplying part) set so as to be different in potential along a direction at which electrons are multiplied from the photocathode 41 to the anode part 34 (in a direction indicated by the arrow B of FIG. 1 and the same shall be applied hereinafter) and provided with a plurality of electron multiplying channels (electron multiplying channels) so as to be astride individual stages. Further, the anode part 34 is arranged at a position holding the electron multiplying parts 33 together with the photocathode 41.

The wall-like electrode 32, the focusing electrodes 31, the electron multiplying parts 33 and the anode part 34 are individually fixed to the lower frame 4 by anode bonding, diffusion joining and joining, etc., using a sealing material such as a low-melting-point metal (for example, indium), by which they are arranged on the lower frame 4 two-dimensionally.

The lower frame 4 is constituted with the rectangular flat-plate like glass substrate 40 as a base material. The glass substrate 40 forms an opposing surface 40*a*, that is, an inner surface of the casing 5, which opposes the opposing surface 20*a* of the wiring substrate 20, by use of glass which is an insulating material. The photocathode 41 which is a transmission-type photocathode is formed at a site opposing a penetration part 301 of the side wall frame 3 on the opposing surface 40*a* (a site other than a joining region with a side wall part 302) and at the end part opposite to the side of the anode part 34. Further, a rectangular recessed part (concave part) 42 which prevents multiplied electrons from being made incident onto the opposing surface 40*a* is formed at a site where the electron multiplying parts 33 and the anode part 34 on the opposing surface 40*a* are loaded.

Figure 3:
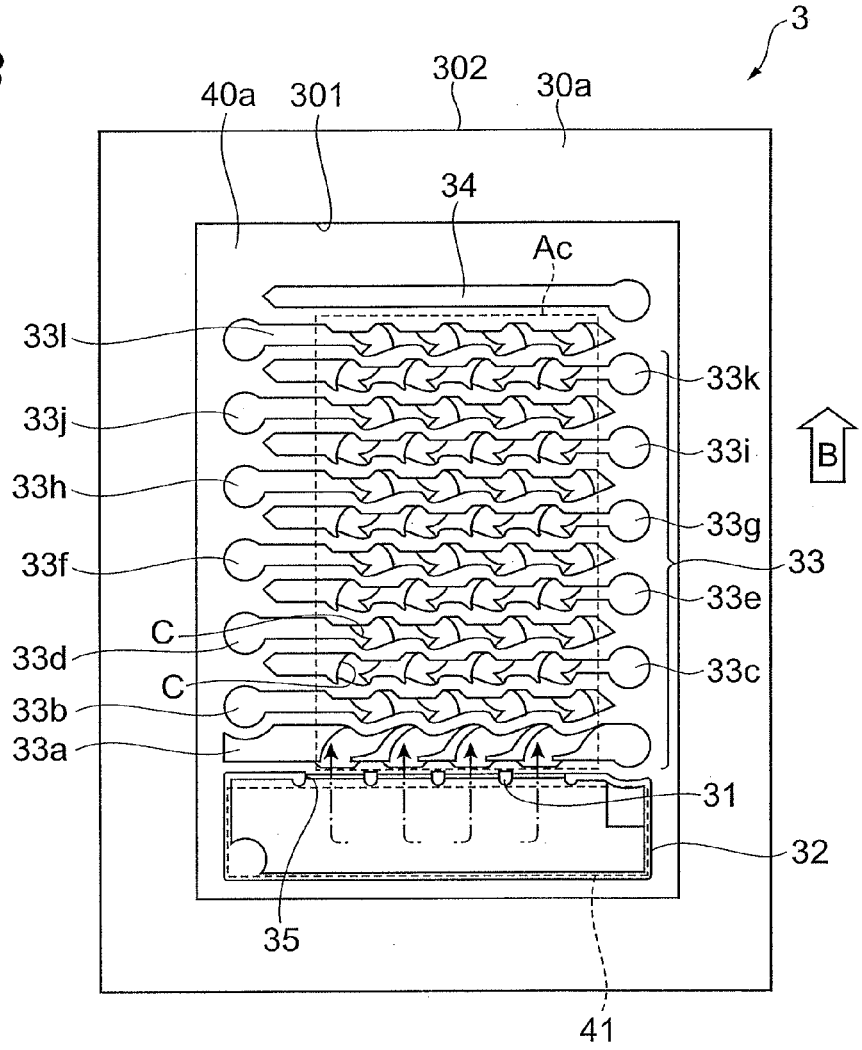
FIG. 3 is a plan view which shows a side wall frame of FIG. 1.
Figure 4:
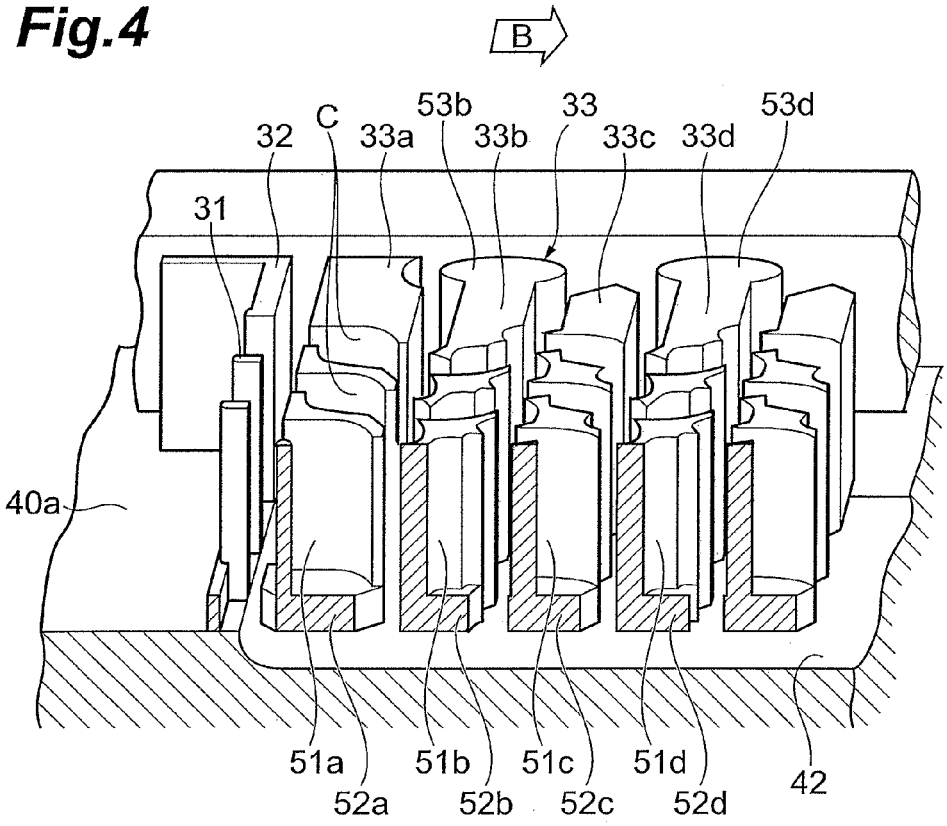
FIG. 4 is a partially broken perspective view which shows major parts of the side wall frame and a lower frame of FIG. 1.
Figure 5:
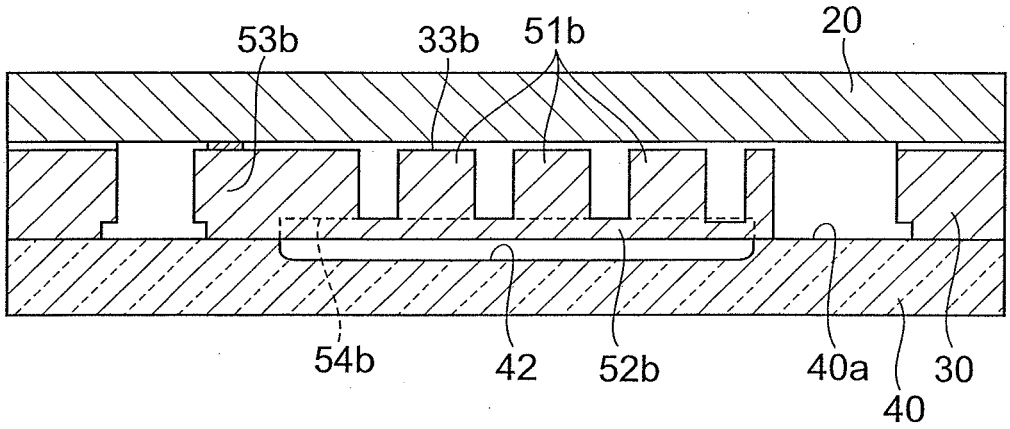
FIG. 5 is a sectional view of the photomultiplier tube of FIG. 1 along the line V to V.

A detailed description will be given for an internal structure of the photomultiplier tube 1 by referring to FIG. 3 to FIG. 5. FIG. 3 is a plan view which shows the side wall frame 3 of FIG. 1. FIG. 4 is a partially broken perspective view which shows major parts of the side wall frame 3 and the lower frame 4 of FIG. 1. FIG. 5 is a sectional view which shows the photomultiplier tube along the line V to V of FIG. 1.

As shown in FIG. 3, the electron multiplying parts 33 inside the penetration part 301 are constituted with a plurality of stages of dynodes 33*a* to 331 arrayed so as to be spaced away sequentially from the first end side on the opposing surface 40*a* to the second end side (in a direction indicated by the arrow B, that is, a direction at which electrons are multiplied). The plurality of stages of dynodes 33*a* to 331 form in parallel a plurality of electron multiplying channels C constituted with the N number of electron multiplying holes installed so as to continue along a direction indicated by the arrow B from a $1^{st}$ stage dynode 33*a* on the first end side to a final stage (an $N^{th}$ stage) dynode 331 on the second end side.

Further, the photocathode 41 is installed so as to be spaced away from the $1^{st}$ stage dynode 33*a* on the first end side to the first end side on the opposing surface 40*a* behind the focusing electrodes 31. The photocathode 41 is formed on the opposing surface 40*a* of the glass substrate 40 as a rectangular transmission-type photocathode. When incident light transmitted from outside through the glass substrate 40, which is the lower frame 4, arrives at the photocathode 41, photoelectrons corresponding to the incident light are emitted, and the photoelectrons are guided into the $1^{st}$ stage dynode 33*a* by the wall-like electrode 32 and the focusing electrodes 31.

Still further, the anode part 34 is installed so as to be spaced away from the final stage dynode 331 on the second end side to the second end side on the opposing surface 40*a*. The anode part 34 is an electrode for taking outside electrons which are multiplied by the electron multiplying part 33 inside the electron multiplying channels C in a direction indicated by the arrow B as an electric signal.

As shown in FIG. 4, a plurality of stages of dynodes 33*a* to 33*d* are arranged so as to be spaced away from the bottom of a recessed part 42 formed on the opposing surface 40*a* of the lower frame 4. The dynode 33*a* is arrayed along the opposing surface 40*a* in a direction substantially perpendicular to a direction at which electrons are multiplied and includes a plurality of columnar parts 51*a* extending in a substantially perpendicular direction toward the opposing surface 20*a* of the upper frame 2 and a base part (a supporting base) 52*a* formed continuously at the end parts of the plurality of columnar parts 51*a* on the side of the recessed part 42 to extend along the bottom of the recessed part 42 in a substantially perpendicular direction with respect to a direction at which electrons are multiplied. The dynodes 33*b* to 33*d* are also similar in structure to the dynode 33*a* respectively with regard to a plurality of columnar parts 51*b* to 51*d* and base parts 52*b* to 52*d*. An electron multiplying channel C is formed between adjacent members at each of the columnar parts 51*a* to 51*d*, and the base parts 52*a* to 52*d* are installed so as to be astride a region $A_c$ (FIG. 3) where the electron multiplying channels C are formed. Here, the base parts 52*a* to 52*d* function to electrically connect each of the plurality of columnar parts 51*a* to 51*d* with each other and also retain the plurality of columnar parts 51*a* to 51*d* so as to be spaced away from the bottom of the recessed part 42. It is noted that in the present embodiment, with regard to the dynodes 33*a* to 33*d*, the plurality of columnar parts 51*a* to 51*d* and the base parts 52*a* to 52*d* are respectively formed in an integrated manner but the columnar parts may be separated from the base parts. Although not illustrated, the dynodes 33*e* to 331 are also similar in structure.

Further, power supplying parts 53*b*, 53*d* formed approximately in a cylindrical shape so as to extend in a substantially perpendicular direction from one end parts of the base parts 52*b*, 52*d* toward the upper frame 2 are formed in an integrated manner at the one end parts of the base parts 52*b*, 52*d* in a direction perpendicular to a direction at which electrons are multiplied. The power supplying parts 53*b*, 53*d* are members for supplying power to the plurality of columnar parts 51*b*, 51*d* via the base parts 52*b*, 52*d*.

As shown in FIG. 5, both end parts of the base part 52*b* in a direction, that is perpendicular to a direction at which electrons are multiplied and along the opposing surface 40*a*, are joined to the opposing surface 40*a*, by which the above-structured dynode 33*b* is fixed to the lower frame 4. The central part 54*b* held between the both end parts of the base part 52*b* is arranged in such a manner that the surface on the side of the opposing surface 40*a* is spaced away from the bottom of the recessed part 42. In other words, with regard to the dynode 33*b*, an electron multiplying region where the electron multiplying channels C are formed is arranged so as to be spaced away from the lower frame 4, and the recessed part 42 is formed on the opposing surface 40*a* of the lower frame 4 so that the both end parts in a direction, that is perpendicular to a direction at which electrons are multiplied and along the opposing surface 40*a*, are given as parts for fixing to the lower frame 4. Further, although there is a slight difference in configuration, the other dynodes 33*a*, 33*c* to 331 are also fundamentally similar in structure in terms of the columnar parts, the base parts and the power supplying parts. Still further, in order to correspond to the above structure, the recessed part 42 on the opposing surface 40*a* is formed at such a width as to be astride the base parts of the plurality of stages of dynodes 33*a* to 331 and the anode part 34 in a direction at which electrons are multiplied. That is, the recessed part 42 is provided with a bottom surface which is recessed in an integrated manner including not only sites corresponding to the dynodes 33*a* to 331 and the anode part 34 but also regions held between them. In addition, a region covering an electron multiplying region where the electron multiplying channel C of the first stage dynode 33*a* is formed and an opposing region which opposes the electron multiplying region of the final stage dynode 331 at the anode part 34 is continuously formed so as to be spaced away from the lower frame 4.

Figure 6:
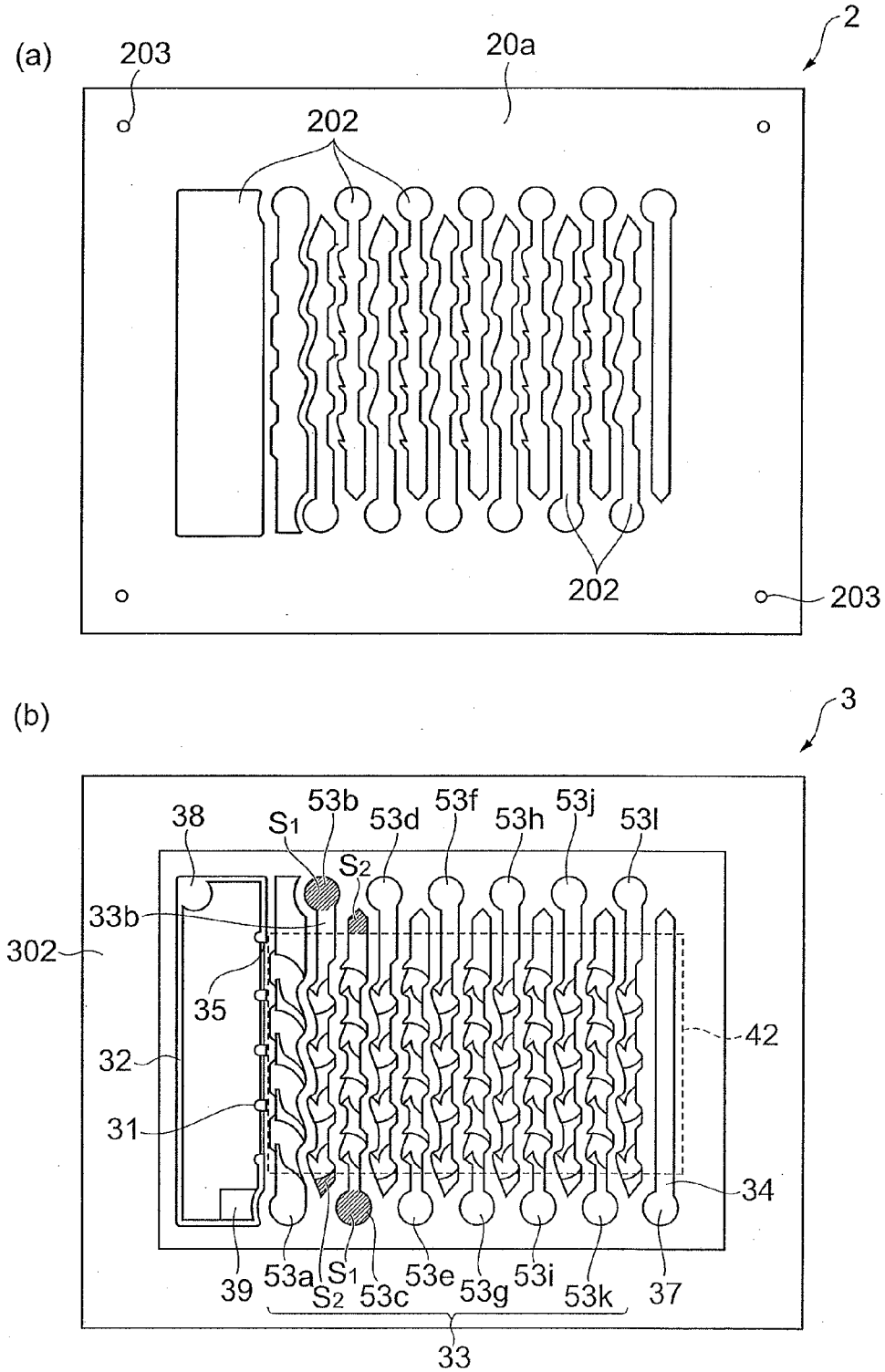
FIG. 6 (*a*) is a bottom view of an upper frame of FIG. 1 when viewed from the back, and FIG. 6 (*b*) is a plan view of the side wall frame of FIG. 1.
Figure 7:
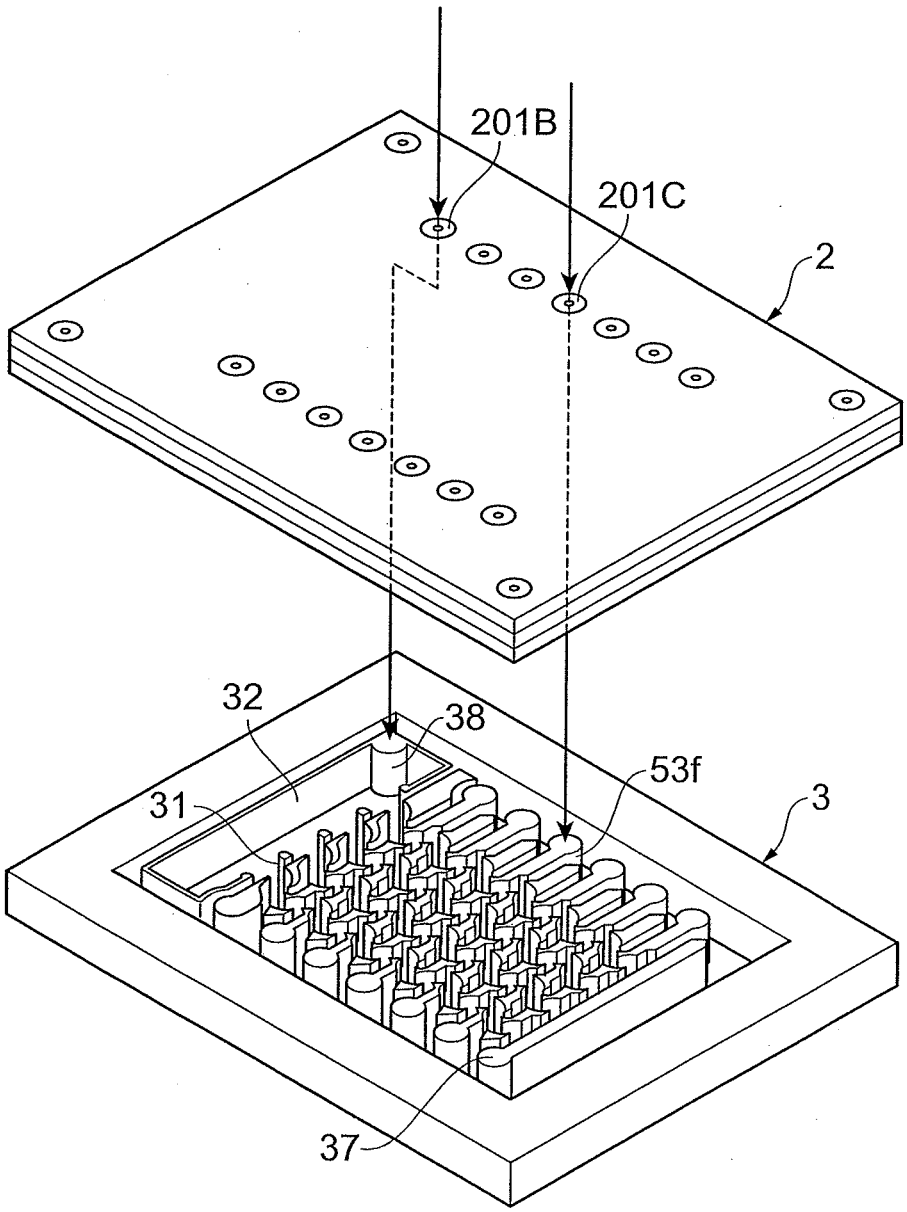
FIG. 7 is a perspective view showing a state which connects the upper frame to the side wall frame as shown in FIG. 6.

Next, a wiring structure of the photomultiplier tube 1 will be described by referring to FIG. 6 and FIG. 7. FIG. 6 (*a*) is a bottom view when the upper frame 2 is viewed from the back surface 20*a* side, and FIG. 6 (*b*) is a plan view which shows the side wall frame 3. FIG. 7 is a perspective view which shows a state connecting the upper frame 2 with the side wall frame 3.

As shown in FIG. 6(*a*), the opposing surface 20*a* of the upper frame 2 is provided with a plurality of conductive layers (power supplying parts) 202 electrically connected to the respective conductive terminals 201B, 201C, 201D inside the upper frame 2 and a conductive terminal 203 electrically connected to the conductive terminal 201A inside the upper frame 2. Further, as shown in FIG. 6(*b*), as already described, the power supplying parts 53*a* to 531 for connecting to the conductive layers 202 are installed upright at the electron multiplying part 33, and a power supplying part 37 for connecting to the conductive layers 202 is installed upright at the end part of the anode part 34. Further, a power supplying part 38 for connecting to the conductive layers 202 is installed upright at a corner of a wall-like electrode 32. Still further, focusing electrodes 31 are formed integrally with the wall-like electrode 32 on the side of the lower frame 4, thereby being electrically connected to the wall-like electrode 32. In addition, a rectangular flat-plate like connecting part 39 is formed integrally at the wall-like electrode 32 on the side of the opposing surface 40*a* of the lower frame 4. A conductive layer (not illustrated) formed electrically in contact with the photocathode 41 on the opposing surface 40*a* is joined to the connecting part 39, by which the wall-like electrode 32 is electrically connected to the photocathode 41.

The above-structured upper frame 2 is joined to the side wall frame 3, by which the conductive terminal 203 is electrically connected to a side wall part 302 of the side wall frame 3. Also, the power supplying parts 53*a* to 531 for the electron multiplying part 33, the power supplying part 37 for the anode part 34 and the power supplying part 38 for the wall-like electrode 32 are respectively connected to the corresponding conductive layers 202 independently via conductive members made with gold (Au), etc. The above-described connecting constitution makes it possible to electrically connect the side wall part 302, the electron multiplying part 33 and the anode part 34 respectively to the conductive terminals 201A, 201C, 201D, thereby power is supplied from outside. Also, the wall-like electrode 32 is electrically connected to the conductive terminal 201B together with the focusing electrode 31 and the photocathode 41, thereby power is supplied from outside (FIG. 7).

Here, as shown in FIG. 6(*b*), the configuration of the base part 52*b* of the dynode 33*b* and that of the power supplying part 53*b* of the dynode 33*b* are specified in such a manner that a cross sectional area $S_1$ along the opposing surface 40*a* at the one end part of both end parts of the base part 52*b* of the dynode 33*b* connecting to the power supplying part 53*b* is greater than a cross sectional area $S_2$ corresponding to a site joined to the opposing surface at another end part of the both end parts. A dimensional relationship of the dynode 33*b* between the one end part where the power supplying part 53*b* is installed and the other end part at a whole end part of the dynode 33*b*, that is, up to the surface on the side of the upper frame 2 is continuously met. Therefore, the one end part where the power supplying part 53*b* is installed is greater than the other end part in terms of the area when viewed from a direction directly opposite from the opposing surface 40*a* and the volume. In addition to the fact that the one end part where the power supplying part 53*b* is installed is superior in physical strength, the surface on the side of the upper frame 2 is larger, by which an area in contact with a conductive member made with gold (Au), etc., can be added to secure electrical connection effectively. Then, the other dynodes 33*a*, 33*c* to 331 which constitute the electron multiplying part 33 are also specified to be such a cross sectional configuration that meets a similar relationship. Further, the plurality of stages of dynodes 33*a* to 331 are arranged in such a manner that the one end part on the side of each of the power supplying parts 53*a* to 531 and the other end part opposite thereto are alternately arranged on the opposing surface 40*a* along a direction at which electrons are multiplied. In other words, the plurality of stages of dynodes 33*a* to 331 are disposed on the opposing surface 40*a* in such a manner that a base part on the basis of a direction at which each of the power supplying parts 53*a* to 531 is arranged (a direction of the base part specified by a direction extending from the one end part where each of the power supplying parts is installed to the other end part) is alternately faced to the opposite direction.

According to the photomultiplier tube 1 which has been so far described, incident light is made incident onto the photocathode 41 and thereby converted to photoelectrons. Then, the photoelectrons are made incident sequentially into the electron multiplying channels C formed by the plurality of stages of dynodes 33*a* to 331 on the inner surface 40*a* of the lower frame 4 inside the casing 5 and multiplied accordingly, and thus multiplied electrons are taken out from the anode part 34 as an electric signal.

Here, a description will be made by exemplifying the dynodes 33*a* to 33*d*. Base parts 52*a* to 52*d* are installed respectively on the dynodes 33*a* to 33*d* at the end part on the side of the lower frame 4. Power supplying parts 53*a* to 53*d* extending from the one end part thereof to the upper frame 2 which opposes the lower frame 4 are electrically connected to the base parts 52*a* to 52*d*, and the power supplying parts 53*a* to 53*d* are connected to the conductive layers 202 installed on the inner surface 20*a* of the upper frame 2, by which power is supplied to each of the dynodes 33*a* to 33*d*. Further, the base parts 52*a* to 52*d* are formed in such a manner that the both end parts thereof are joined to the opposing surface 40*a* of the lower frame 4, the central part thereof is spaced away from the opposing surface 40*a*, and a cross sectional area $S_1$ along the opposing surface 40*a* at the one end part on the side of each of the power supplying parts 53*a* to 53*d* is made greater than a cross sectional area $S_2$ at the other end part. Thereby, at a region where the insulating surface of the lower frame 4 is easily electrically charged by secondary electrons and photoelectrons which are made incident, each of the dynodes 33*a* to 33*d* is spaced away from the insulating surface of the lower frame 4, thus making it possible to suppress a decrease in withstand voltage. At the same time, the end parts of the base parts 52*a* to 52*d* at site sides in contact with the conductive layers 202 of the upper frame 2 are increased in strength, by which the electron multiplying part 33 is secured for physical strength when pressure is applied due to contact for supplying power. It is, therefore, possible to suppress the decrease in withstand voltage without deformation, breakage, etc.

Further, the recessed part 42 is formed on the opposing surface 40*a* of the lower frame 4 and the central parts of the base parts 52*a* to 52*d* are arranged over the recessed part 42. Therefore, the central parts of the base parts 52*a* to 52*d* can be spaced away from the insulating surface of the lower frame 4 without any decrease in strength of the electron multiplying part 33. Still further, since the recessed part 42 is formed so as to be astride the central parts of the plurality of base parts 52*a* to 52*d*, it is possible to further suppress a decrease in withstand voltage by preventing the electric charge due to secondary electrons passing between the plurality of stages of dynodes 33*a* to 33*d* which are made incident onto the insulating surface.

Figure 8:
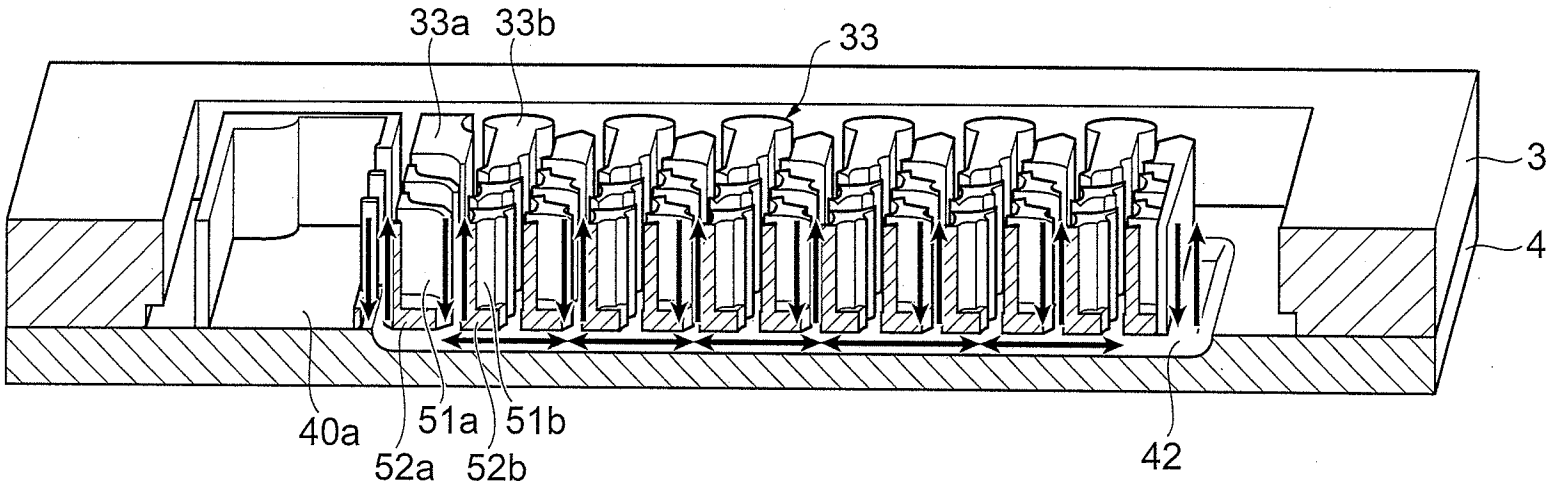
FIG. 8 is a partially broken perspective view which shows the side wall frame and the lower frame of FIG. 1.

Then, each of the dynodes 33*a* to 331 is spaced away from the opposing surface 40*a* of the lower frame 4, by which the following effects are obtained. That is, the dynodes 33*a*, 33*b* are used as examples. When secondary electron surfaces on the surfaces of the columnar parts 51*a*, 51*b* are activated, the vapors of an alkali metal (such as K or Cs) will flow better between the stages of dynodes 33*a*, 33*b* and below the dynodes 33*a*, 33*b* (in a direction indicated by the arrow in FIG. 8), thus making it possible to easily form a uniform secondary electron surface. Further, a joined area between the electron multiplying part 33 and the lower frame 4 can be decreased, thus making it possible to prevent defective joining caused by holding a foreign substance between the electron multiplying part 33 and the lower frame 4 and obtain a high degree of reliability. Still further, such a structure is provided that the recessed part 42 is installed to allow the dynodes 33*a* to 331 to be spaced away, thus making it possible to increase an internal volume of the casing 5. Therefore, it is possible to suppress a decrease in the degree of vacuum even if gas is released from an internal constituent. For example, as compared with a photomultiplier tube having the dynodes 33*a* to 331 with the thickness of 1 mm but not having the recessed part 42, a photomultiplier tube having the dynodes 33*a* to 331 equal in thickness, the recessed part 42 with the depth of 0.2 mm and a processed area ratio of the recessed part 42 to the opposing surface 40*a* which is 50% is able to increase the internal volume by about 10%. In addition, even where there is a foreign substance inside the casing 5, the foreign substance may easily fall down into the recessed part 42 which is spaced away from the dynodes 33*a* to 331. Therefore, the foreign substance is less likely to be held between the dynodes 33*a* to 331, thus resulting in fewer cases of defective withstand voltage due to the foreign substance. Since a contact area between the casing 5 and the dynodes 33*a* to 331 is decreased, the electron multiplying part 33 is less influenced by a change in temperature inside the casing 5, thereby alleviating the damage of a secondary electron surface in association with an increase in ambient temperature. In particular, this effect is important in a structure where electrodes such as the electron multiplying part are directly arranged on an inner surface of the casing 5.

Figure 9:
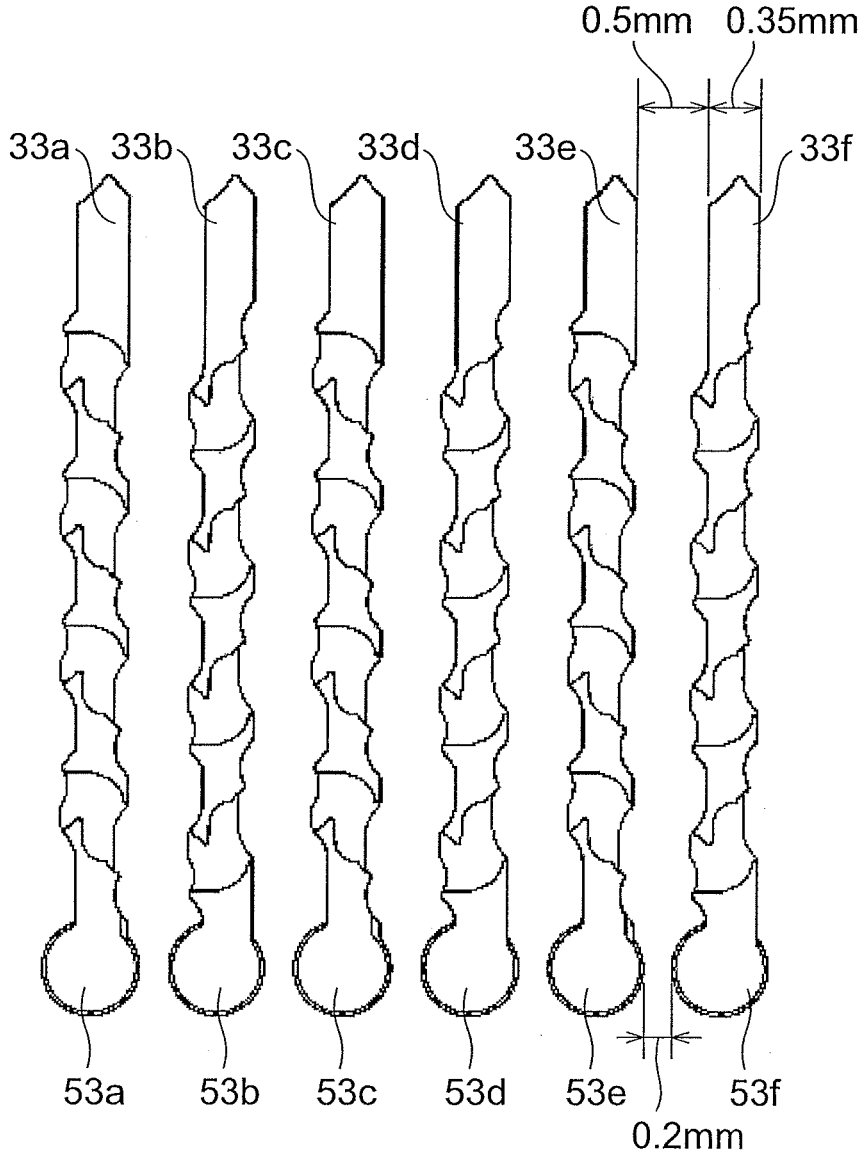
FIG. 9 is a plan view which shows an electron multiplying part related to a comparative example of the present invention.
Figure 10:
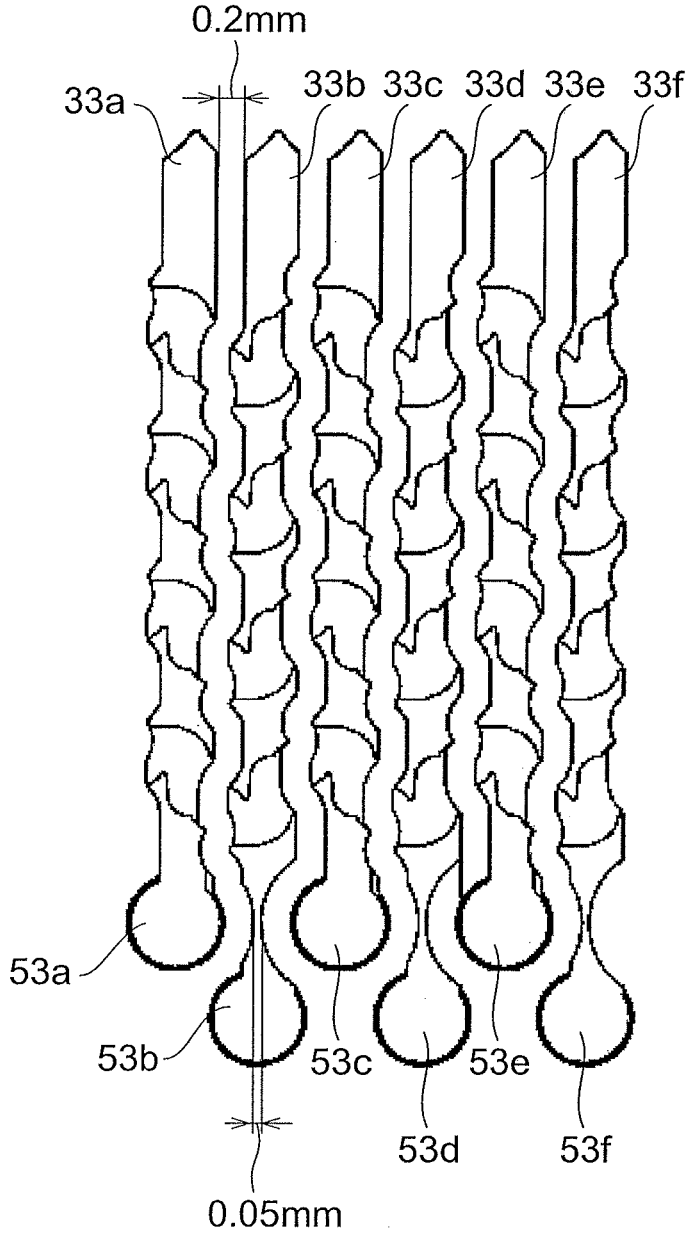
FIG. 10 is a plan view which shows an electron multiplying part of another comparative example of the present invention.

Further, the plurality of base parts corresponding to the plurality of stages of dynodes 33*a* to 331 are constituted in such a manner that the one end part on the side of each of the power supplying parts 53*a* to 531 and the other end part thereof are alternately placed along the opposing surface 40*a* of the lower frame 4. That is, for example, in the dynode 33*b* and the dynode 33*c* which are adjacent to each other, the end part of the dynode 33*c* which opposes the one end part on the side of the power supplying part 53*b* of the dynode 33*b* is placed so as to be the other end part, while the end part of the dynode 33*c* which opposes the other end part of the dynode 33*b* is placed so as to be the one end part on the side of the power supplying part 53*c*. Then, the plurality of stages of dynodes 33*a* to 331 are placed so as to meet the above relationship. That is, since the other end part of an adjacent dynode is adjacent to the one end part on the side of each of the power supplying parts 53*a* to 531, it is possible to increase a cross sectional area along the lower frame 4 at the end part of each base part on the side of the power supplying parts 53*a* to 531. Thereby, the electron multiplying part 33 can be further increased in physical strength. Further, the other end parts of the plurality of stages of dynodes 33*b* to 331 are given as columnar parts extending toward the upper frame 2 in a substantially perpendicular direction, and when viewed in a direction directly opposite to the opposing surface 40*a* of the lower frame 4, the leading end part thereof is drawn to the side of the recessed part 42 to a greater extent than the power supplying parts 53*a* to 531. Therefore, there is a greater clearance between the other end parts and the power supplying parts 53*a* to 531. Still further, a cross sectional configuration of the other end part along the lower frame 4 (a configuration when viewed from a direction directly opposite to the opposing surface 40*a* of the lower frame 4) is provided with a pointed configuration extending in a direction which is substantially perpendicular to a direction at which electrons are multiplied (a direction moving from the one end part to the other end part of each of the dynodes). The pointed configuration is provided as described above, by which an area joined to the lower frame 4 can be increased, with the clearance with respect to the power supplying parts 53*a* to 531 kept, thereby suppressing a decrease in withstand voltage. On the other hand, as shown in FIG. 9, where the end parts on the side of the power supplying parts 53*a* to 531 are arranged so as to be placed adjacently along the opposing surface 40*a*, it is necessary to increase a clearance between dynodes (for example, 0.5 mm for a dynode whose thickness is 0.35 mm), with consideration given to a withstand voltage between the power supplying parts 53*a* to 531. As a result, where dynodes are arranged in the same number, a greater area is needed, and where a silicon substrate is subjected to batch process, an area per chip is increased, which may result in an increased cost of the chip. Further, a greater clearance between the dynodes will result in a decrease in the electron multiplication factor, thus decreasing the performance as a photomultiplier tube. On the other hand, in order to narrow a clearance between the dynodes, as shown in FIG. 10, the power supplying parts 53*a* to 53*f* of the dynodes 33*a* to 33*f* may be deviated alternately and arranged adjacently so as to meander along the opposing surface 40*a*. Thereby, a clearance between the dynodes can be narrowed (for example, 0.2 mm) to increase the electron multiplication factor to some extent. However, at the dynodes 33*b*, 33*d* where the power supplying parts 53*b*, 53*d* project, in order to keep a withstand voltage between the stages, it is necessary to extremely narrow sites between the end parts on the side of the power supplying parts 53*b*, 53*d* and the central parts of the dynodes 33*b*, 33*d* (for example, 0.05 mm). As a result, there is a case where the dynodes 33*b*, 33*d* are decreased in strength to result in breakage due to the occurrence of cracks and no power is supplied to a secondary electron surface. Or, even if no cracks occur, an electric resistance value is increased, which may hinder the supply of potential to the central part of a dynode having the secondary electron surface from the power supplying parts 53*b*, 53*d*. Therefore, the arrangement of the dynodes 33*a* to 331 in the present embodiment is able to suppress a decrease in withstand voltage and also arrange the dynodes so as to narrow the clearance, which is found effective in terms of the electron multiplication factor as well.

Figure 11:
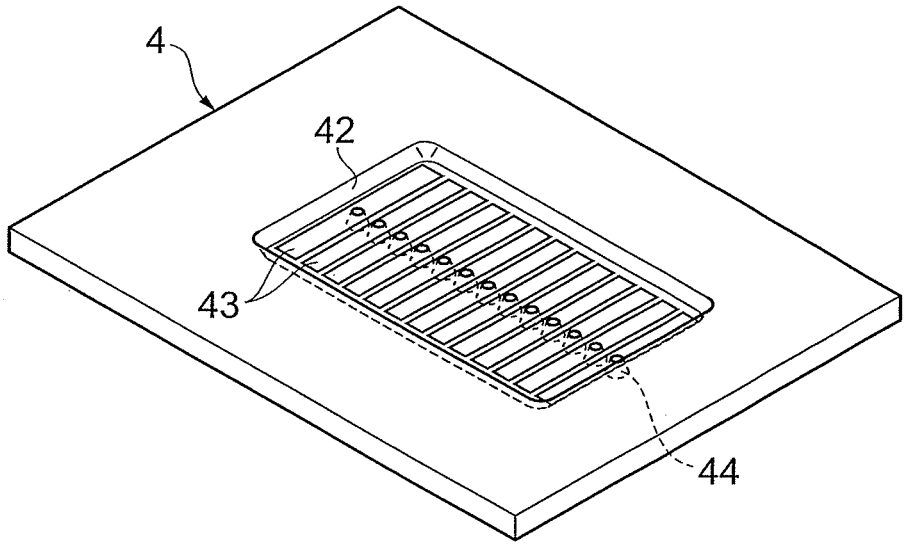
FIG. 11 is a perspective view which shows a lower frame related to a modified example of the present invention.
Figure 12:
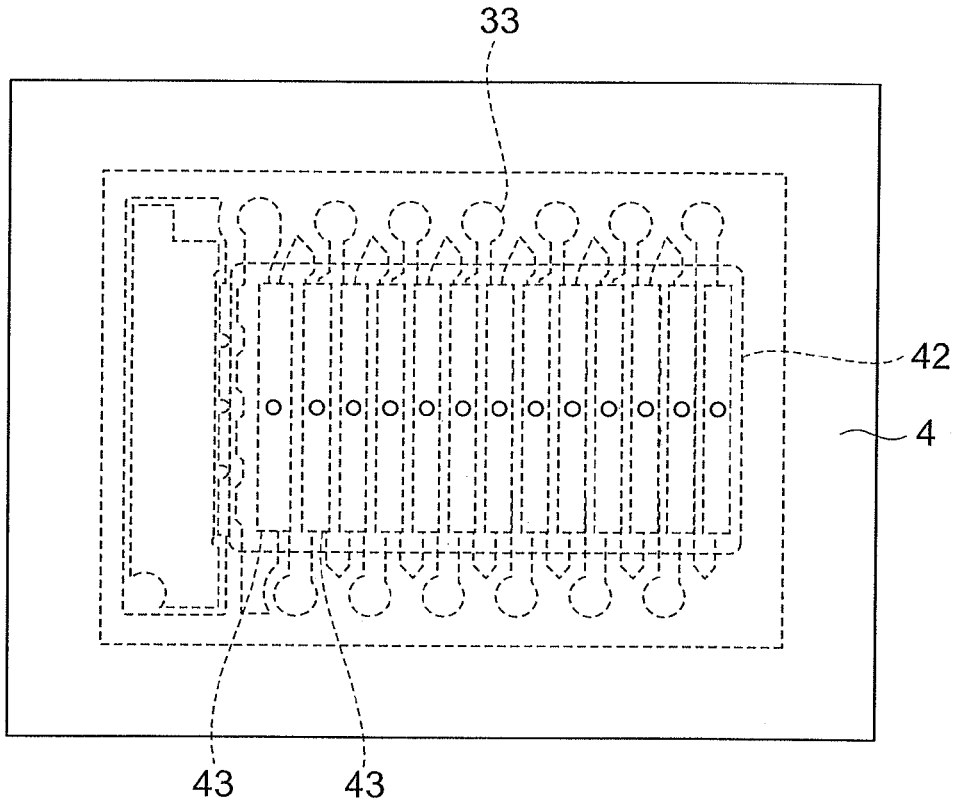
FIG. 12 is a bottom view when the lower frame of FIG. 11 is viewed from the back surface side.
Figure 13:
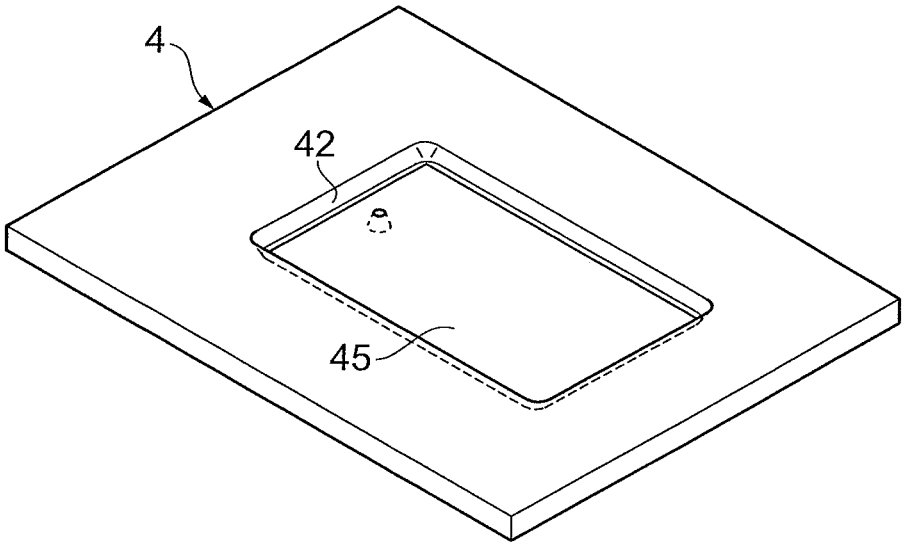
FIG. 13 is a perspective view which shows a lower frame related to another modified example of the present invention.

It is noted that the present invention shall not be limited to the embodiments so far described. For example, as shown in FIG. 11 and FIG. 12, a plurality of band-like conductive layers 43 may be formed on the bottom of the recessed part 42 of the lower frame 4 corresponding to positions between the respective stages of the dynodes 33*a* to 331 at the electron multiplying part 33 and between the electron multiplying part 33 (the dynode 331) and the anode part 34 in such a manner that the insulating surface of the lower frame 4 is not exposed. Power is supplied to the conductive layers 43 by the conductive terminals 44 installed so as to penetrate through the lower frame 4. It is possible, thereby, to reliably prevent the electric charge by electrons passing through the electron multiplying part 33 which are made incident onto the lower frame 4. Further, as shown in FIG. 13, the conductive layers 45 are installed on the bottom of the recessed part 42 so as to be astride the electron multiplying part 33 as a whole, thus making it possible to prevent the electric charge of the lower frame 4. However, in this case, since there is a great difference in potential between the conductive layers 45 and individual dynodes at the electron multiplying part 33, the constitution shown in FIG. 11 is more preferable.

In the present embodiment, the photocathode 41 is a transmission-type photocathode but may be a reflection-type photocathode. Further, the photocathode 41 may be arranged on the side of the upper frame 2. Where the photocathode 41 is arranged on the side of the upper frame 2, the upper frame 2 may include that in which power supplying terminals are buried into an insulating substrate having light transmittance such as a glass substrate, and the lower frame 4 may include various insulating substrates other than a glass substrate. Further, the anode part 34 may be arranged between the dynode 33*k* and the dynode 331.

What is claimed is:

1. A photomultiplier tube comprising:

a housing which includes a first substrate and a second substrate which are arranged so as to oppose each other, with the respective opposing surfaces made with an insulating material;

an electron multiplying part which has a plurality of stages of dynodes arrayed so as to be spaced away sequentially along one direction from a first end side to a second end side on the opposing surface of the first substrate;

a photocathode which is installed at the first end side inside the housing so as to be spaced away from the electron multiplying part, thereby converting incident light from outside to photoelectrons to emit the photoelectrons; and an anode part which is installed at the second end side inside the housing so as to be spaced away from the electron multiplying part to take out electrons multiplied by the electron multiplying part as a signal; wherein a power supplying part for supplying power to the electron multiplying part is installed on the opposing surface of the second substrate, the electron multiplying part is provided with supporting bases, each of which is electrically connected to the end part of each of the plurality of stages of dynodes on the side of the first substrate and installed so as to be astride electron multiplying channels formed with the plurality of stages of dynodes and a power supplying member which is formed so as to extend from one end part of both end parts of each of the supporting bases in a direction along the opposing surface of the first substrate to the second substrate and electrically connected to the power supplying part, the supporting bases are constituted in such a manner that surfaces of the both end parts on the side of the opposing surface of the first substrate are joined to the opposing surface, and also whole surfaces of central parts held between the both end parts are spaced away from the opposing surface of the first substrate in a continuous region astride the plurality of stages of dynodes, a cross sectional area along the opposing surface at the one end part of the both end parts on the side of the power supplying member is made greater than a cross sectional area at another end part of the both end parts, and a width in the one direction at the one end part of the side of the power supplying member is made greater than a width at another end part.

2. The photomultiplier tube according to claim 1, wherein a recessed part is formed on the opposing surface of the first substrate and the central part of the supporting base is arranged over the recessed part, thereby being spaced away from the opposing surface.

3. The photomultiplier tube according to claim 2, wherein the recessed part is formed so as to be astride a plurality of supporting bases individually connected to the plurality of stages of dynodes.

4. The photomultiplier tube according to claim 1, wherein the plurality of supporting bases corresponding to the plurality of stages of dynodes are arranged in such a manner that the one end part and the other end part are alternately placed along the opposing surface of the first substrate.

* * * * *